US005101328A

United States Patent [19]

Hai

[11] Patent Number: 5,101,328

[45] Date of Patent: Mar. 31, 1992

[54] LAND/WATER CANDLE HOLDER

[76] Inventor: Lee H. Hai, No. 77, Lane 508, Chungcheng N. Rd., Sanchung, Taipei Hsien, Taiwan

[21] Appl. No.: 734,756

[22] Filed: Jul. 23, 1991

[51] Int. Cl.[5] ..... F21L 19/00

[52] U.S. Cl. ..... 362/163; 362/161

[58] Field of Search ..... 362/161, 162, 163; 431/291

[56] References Cited

U.S. PATENT DOCUMENTS 4,186,430 1/1980 Britton ..... 362/161

4,937,770 6/1990 Schroder ..... 362/161

*Primary Examiner*—Carroll B. Dority

*Attorney, Agent, or Firm*—Laos & Keegan

[57] ABSTRACT

A candle holder includes a bowl having a recessed portion for receiving a candle therein, a housing securely attached to the bowl, and a number of air inlet tubes for introducing fresh air into the housing via air passages formed in the bowl. The housing has an upper opening through which a candle is passable so as to be placed on the bowl. An upper cover is removably attached to the upper opening of the housing. A first tube is formed in a central portion of the upper cover, and a second tube is slidably received in the first tube for conducting exhaust air to an outside of the housing. An annular ring is connected to a lower end of the second tube by a number of spaced ribs for holding an upper end of the candle, preventing molten wax from dripping. A plurality of passages are defined by the spaced ribs through which fresh air is passable to the candle. A floating member is provided for retaining an air inlet port of each of the air inlet tubes to be above a water level when the candle holder is put into water. A top cover, supported by posts provided on the floating member, is provided for shielding an air outlet port from rain.

6 Claims, 3 Drawing Sheets

LAND/WATER CANDLE HOLDER

BACKGROUND OF THE INVENTION

The present invention relates to an improved candle holder, and more particularly to an improved candle holder which can be used both on land and in water.

The utilization of candles is limited since the flame is unstable in wind, most likely being extinguished in a strong wind. In addition, candles cannot used either outdoors on rainy days or in water. Moreover, the user might be burnt by a flame shade of a candle holder due to inefficient insulation and bad cooling effect thereof.

The present invention provides an improved candle holder which can be used on strong winds, in rainy days, and in water.

SUMMARY OF THE INVENTION

According to one aspect of the present invention, a candle holder includes a bowl having a recessed portion for receiving a candle therein. A plurality of first holes are provided on an inner periphery of the bowl, and a corresponding number of second holes, each in fluid communication with a corresponding first hole, are provided on an upper surface of the bowl for introducing fresh air.

A housing having an inner diameter the same as an inner diameter of the bowl is securely attached to the bowl. A plurality of holes are provided on the lower end of the housing, each are in alignment with the first holes on the inner periphery of the bowl after engagement. The housing has an upper opening through which the candle is passable to be placed on the bowl.

A corresponding number of air inlet tubes are securely positioned in the second holes of the bowl to induct fresh ambient air into the housing via the first holes.

An upper cover is removably attached to the upper opening of the housing. A first tube is formed in a central portion of the upper cover, and a second tube is slidably received in the first tube. An annular ring is connected to a lower end of the second tube by a plurality of spaced ribs for holding an upper end of the candle, preventing molten wax from dripping. A plurality of passages are defined by the spaced ribs through which fresh air is passable to a candlewick of the candle. The exhaust gas is lead outside the housing by the second tube.

According to another aspect of the invention, the candle holder may further include an insulating sleeve provided around a portion of the first tube above the housing, preventing the user from being burnt.

According to still another aspect of the invention, the candle holder further includes a floating member for retaining an air inlet port of each of the air inlet tubes to be above a water level when the candle holder is put into water.

According to yet another aspect of the invention, the candle holder may further have a top cover for shielding an air outlet port from rain. The top cover is provided posts on the floating member. Optionally, a weight can be attached to an underside of the bowl by a chain for retaining the candle holder in position when the candle holder is put into water.

It is an object of the present invention to provide an improved candle holder which can be used both on land and in water.

It is another object of the present invention to provide an improved candle holder in which molten wax does not drip.

It is still another object of the present invention to provide an improved candle holder in which a top cover is provided such that the candle holder can be used in rainy conditions.

It is yet another object of the present invention of the present invention to provide an improved candle holder in which an insulating sleeve is provided for protecting the user from being burnt.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
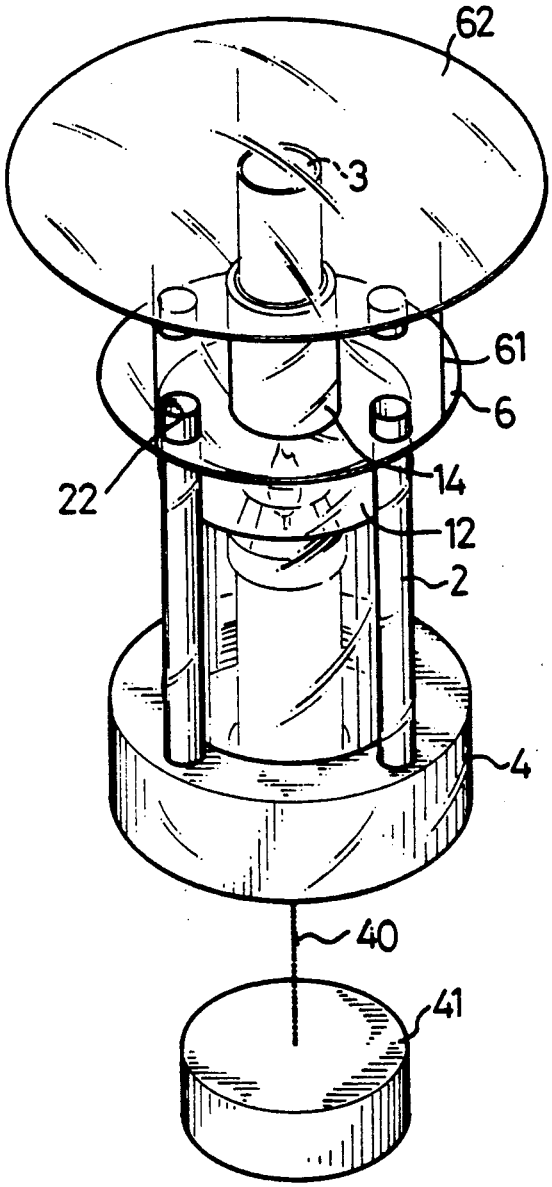
FIG. 1 is a perspective view of a candle holder according to the present invention.
Figure 2:
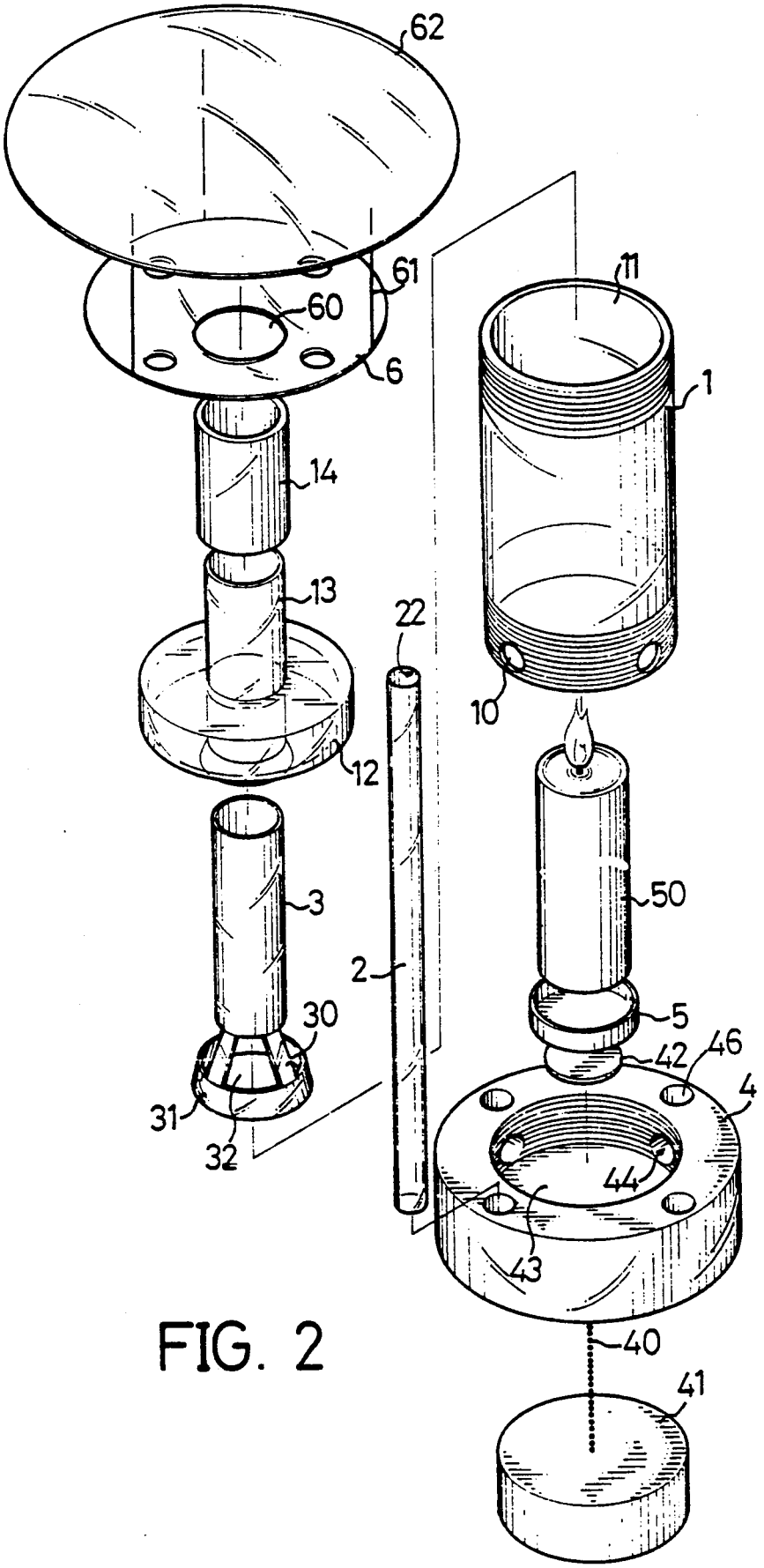
FIG. 2 is an exploded view of the candle holder of the present invention.
Figure 3:
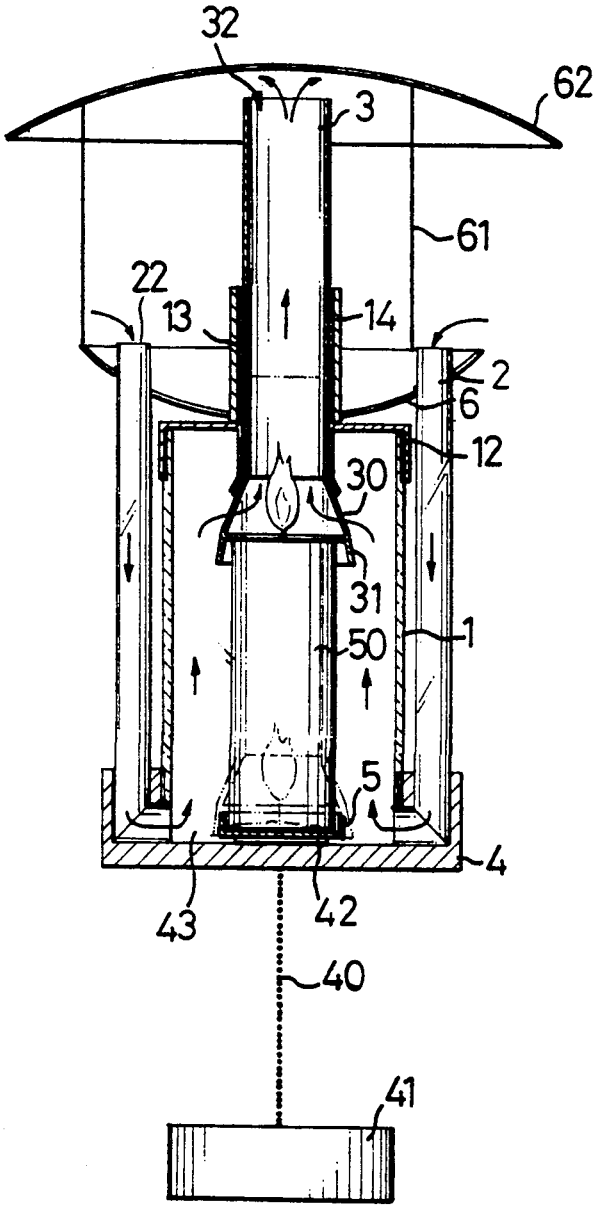
FIG. 3 is a cross-sectional view of the candle holder of the present invention.

Referring to FIGS. 1 through 3, a candle holder according to the present invention includes a bowl 4 having a recessed portion 43 for receiving a candle 50 therein. In this embodiment, the candle 50 is firstly securely received in a socket 5 and then securely attached to the recessed portion 43 of the bowl 4 by a permanent magnet 42. A plurality of first holes 44 are provided on an inner periphery of the bowl 4, and a corresponding number of second holes 46, each in fluid communication with a corresponding first hole 44, are provided on an upper surface of the bowl 46 for introducing fresh air, which will be discussed later.

A housing 1, having an inner diameter the same as an inner diameter of the bowl 4 and having a height greater than that of the candle 50, is securely attached to the bowl 4. In this embodiment, a lower end of the housing 1 is threaded at an outer surface thereof for engagement with the threaded inner periphery of the bowl 4. A plurality of holes 10 are provided on the lower end of the housing 1, each are in alignment with a corresponding first holes 44 on the inner periphery of the bowl 4 after engagement. The housing 1 has an upper opening 11 through which the candle 50 is passable to be placed on the bowl 4.

A corresponding number of air inlet tubes 12 are securely positioned in the second holes 46 of the bowl 4 to introduce fresh ambient air into the housing 1 via the first holes 44.

An upper cover 12 is removably attached to the upper opening 11 of the housing 1. A first tube 13 is formed in a central portion of the upper cover 12, and a second tube 3 is slidably received in the first tube 13. An annular ring 31 is connected to a lower end of the second tube 3 by a plurality of spaced ribs 30 for holding an upper end of the candle 50, preventing molten wax from dripping. As can be seen in FIG. 2, a plurality of passages 32 are defined by the spaced ribs 30 through which fresh air is passable to a candlewick (not labeled) of the candle 50. The exhaust gas is ushered outside the housing 1 via an output port 32 of the second tube 3.

As indicated by arrows in FIG. 3, fresh air is introduced into the housing 1 via the air inlet tubes 3, entering the burning space defined by the ribs 30. And the exhaust gas escapes outside via the second tube 3. Still referring to FIG. 3, when the wax material of the candle 50 is gradually consumed, the annular ring 31 rides the "lowering" upper end of the candle 50, preventing wax from the candle 50 from dripping (see the phantom lines in this figure).

The candle holder may further include an insulating sleeve 14 provided around a portion of the first tube 13 above the housing 1, preventing the user from being burnt.

The candle holder may further include a floating member 6 for retaining an air inlet port 22 of each air inlet tube 2 above a water level when the candle holder is put into water.

The candle holder may further have a top cover 62 for shielding the air outlet port 32 from rain. The top cover 62 is supported by posts 61 on the floating member 6. Optionally, a weight 41 can be attached to an underside of the bowl 4 by a chain 40 for retaining the candle holder in a stable position when the candle holder is put into water.

Although the invention has been explained in relation to its preferred embodiment, it is to be understood that many other possible modifications and variations can be made without departing the spirit and scope of the invention as hereinafter claimed.

I claim:

1. A candle holder comprising:

a bowl having a recessed portion for receiving a candle therein and a plurality of air passages formed on an inner periphery thereof;

a corresponding number of air inlet tubes securely provided on said bowl and in fluid communication with said air passages;

a housing having a height greater than that of the candle, said housing having an upper opening through which the candle is passable to be put in said bowl;

an upper cover removably attached to said upper opening of said housing, a first tube being formed in a central portion of said upper cover; and a second tube slidably received in said first tube for guiding exhaust air to leave said candle holder, an annular ring being connected to a lower end of said second tube by a plurality of spaced ribs for holding an upper end of the candle, preventing molten wax from dripping, a plurality of passages being defined by said spaced ribs through which fresh air is passable to a candlewick of the candle.

2. The candle holder as claimed in claim 1, further comprising a sleeve provided around a portion of said first tube above said housing.

3. The candle holder as claimed in claim 1, further comprising a ferrous socket for receiving the candle, and said ferrous socket being securely attached to a bottom surface of said recessed portion by a permanent magnet.

4. The candle holder as claimed in claim 1, further comprising a floating means for retaining air inlet ports of said air inlet tubes above a water level when said candle holder is put into water.

5. The candle holder as claimed in claim 4, further comprising a top cover supported by posts on said floating means for shielding said air outlet port from rain.

6. The candle holder as claimed in claim 4, further comprising a weight attached to an underside of said bowl for retaining said candle holder in a stable position when put in water.

* * * * *